United States Patent [19]

Clauss

[11] 3,991,805

[45] Nov. 16, 1976

[54] RETRACTABLE AWNING OF ADJUSTABLE ANGLE OF INCLINATION

[75] Inventor: Manfred Clauss, Westerheim, Germany

[73] Assignee: Firma Clauss-Markisen, Ochsenwang, Germany

[22] Filed: Mar. 12, 1976

[21] Appl. No.: 666,250

[30] Foreign Application Priority Data

Apr. 5, 1975 Germany ..... 2514941

[52] U.S. Cl. ..... 160/22; 160/68

[51] Int. Cl.[2] ..... E04F 10/06

[58] Field of Search ..... 160/22, 23 R, 68, 167; 248/299; 403/82; 135/5 AT

[56] References Cited

UNITED STATES PATENTS

| | | | |
|---|---|---|---|
| 854,933 | 5/1907 | De Young | 160/22 |
| 1,286,541 | 12/1918 | Cook | 248/299 |
| 2,445,039 | 7/1948 | Rusnok | 248/299 |
| 3,327,724 | 6/1967 | Nielsen | 135/5 AT |
| 3,782,443 | 1/1974 | Clauss et al. | 160/22 |

*Primary Examiner*—Peter M. Caun

*Attorney, Agent, or Firm*—William R. Woodward

[57] ABSTRACT

The shaft on which the awning web may be rolled up is mounted in a housing with a substantially cylindrical inner cavity having a slot along its length for passage of the web. C-shaped brackets, open in the region of the slot, can be slid onto the housing, with notches locking on ridges of the housing to prevent relative rotation, and these brackets may be clamped on wall-mounted bases at an adjustable angle by means of clamping shells affixed to the mounting bases. The extension arms linked to the bottom slat have their inner ends mounted on the forward portions of two of the brackets and these arms fold up against the housing as the bottom slat is pulled up against the housing when the awning is retracted.

11 Claims, 5 Drawing Figures

RETRACTABLE AWNING OF ADJUSTABLE ANGLE OF INCLINATION

This invention concerns an awning of the kind having a wall-affixable housing, of a form readily made of an extruded light-metal slotted tube, in which a web-carrying roller shaft is mounted, the housing being closed off at the end by cap-like pieces and at the front also, in the rolled-up condition of the awning, by a bottom rod or slat connected to the housing by articulated arms.

U.S. Pat. No. 2,487,639 shows a known form of awning of the general type just mentioned. In this known form, the housing has a substantially rectangular cross-section and is a section of a length of a light-metal extrusion product shaped for the purpose. The rectangular housing can be screwed onto a mounting plate by screws passing through the rear wall of the housing, an operation that is feasible only in the disassembled condition of the awning, i.e. when the awning-web roll is removed from the housing. The lengthwise slot permitting the web to pass in and out of the housing is provided in the region of the forward lower edge of the housing, at which place the housing is cut away or faired so that a cylindrical bottom rod of the awning will fit against the housing when the awning is fully rolled up. In this form of construction the awning casing must have a cross-sectional diagonal substantially greater than the diameter of the fully rolled-up awning web roll. Besides, the articulated arms carrying the bottom rod are mounted at some considerable distance below the awning housing on the wall or other such surface, a feature that limits the utilization of the awning to cases in which a vertical wall is present on which the articulated arms and their mountings or sockets can be affixed.

It is an object of this invention to provide an awning of the general kind above described capable of being mounted into place in the assembled condition in a simple way, requiring no separate mounting bases or locations for the linking arms, and that is, furthermore, adjustable at any angle according to the particular requirements of the place of use.

SUMMARY OF THE INVENTION

Briefly, the awning housing is carried in partly encircling wall-mounted holders on one end of which the extension arms are respectively connected. The holders are themselves mounted on the wall or other similar surface in a manner permitting them to be rotated about a horizontal axis and to be clamped in any position into which they can thus be adjusted.

The new awning of this invention is constituted as a constructional unit that can also be provided in any desired length. For installation of the awning it is necessary merely to attach to holders to the wall or other bearing surface and then clamp the holders for the desired angle of inclination of the extension arms in their extended position.

In a preferred embodiment the structure is so constituted that the wall-mounting holders respectively comprise brackets each having at least one substantially circular C-shaped part by which each bracket is clamped to a wall-mounted base. The wall-mounted base can in such case carry two clamping shells each fitting cross-sectional form of the C-shaped part, which can thereby be clamped on both sides of a single bracket. In order to assure a tight-fitting mounting of the bracket, it is desirable to have each bracket, in the region of its C-shaped part, carry a sidewardly projecting circularly running rib, which grips into a corresponding groove of the adjacent clamping shell.

The awning housing itself can be non-rotatably connected to the brackets, which can simply be accomplished by providing the housing with at least one longitudinal rib or groove, which will engage with a notch or projection, as the case may be, of each of the brackets.

The awning housing can conveniently be made substantially cylindrical. In that way the internal shape of the housing matches substantially the contour of the rolled-up awning cloth or web, so that the housing has a very small space requirement. The roller shaft for the web, moreover, need no intermediate bearing, even for great lengths, because a certain amount of bending of the shaft is tolerable, because the awning web roll can bear directly on the smooth cylindrical inner surface of the awning housing.

In order to prevent dirt present in a dusty environment from subsequently being ground into the web by friction when the awning is rolled up, it is effective to make the housing fully closed up except for a lengthwise slot allowing the web to pass and to provide a brush for the web in elongated form extending over the entire length of the slot.

BRIEF DESCRIPTION OF THE DRAWINGS

The invention is further described by way of example with reference to the accompanying drawings, in which.

DESCRIPTION OF THE PREFERRED EMBODIMENT

Figure 1:
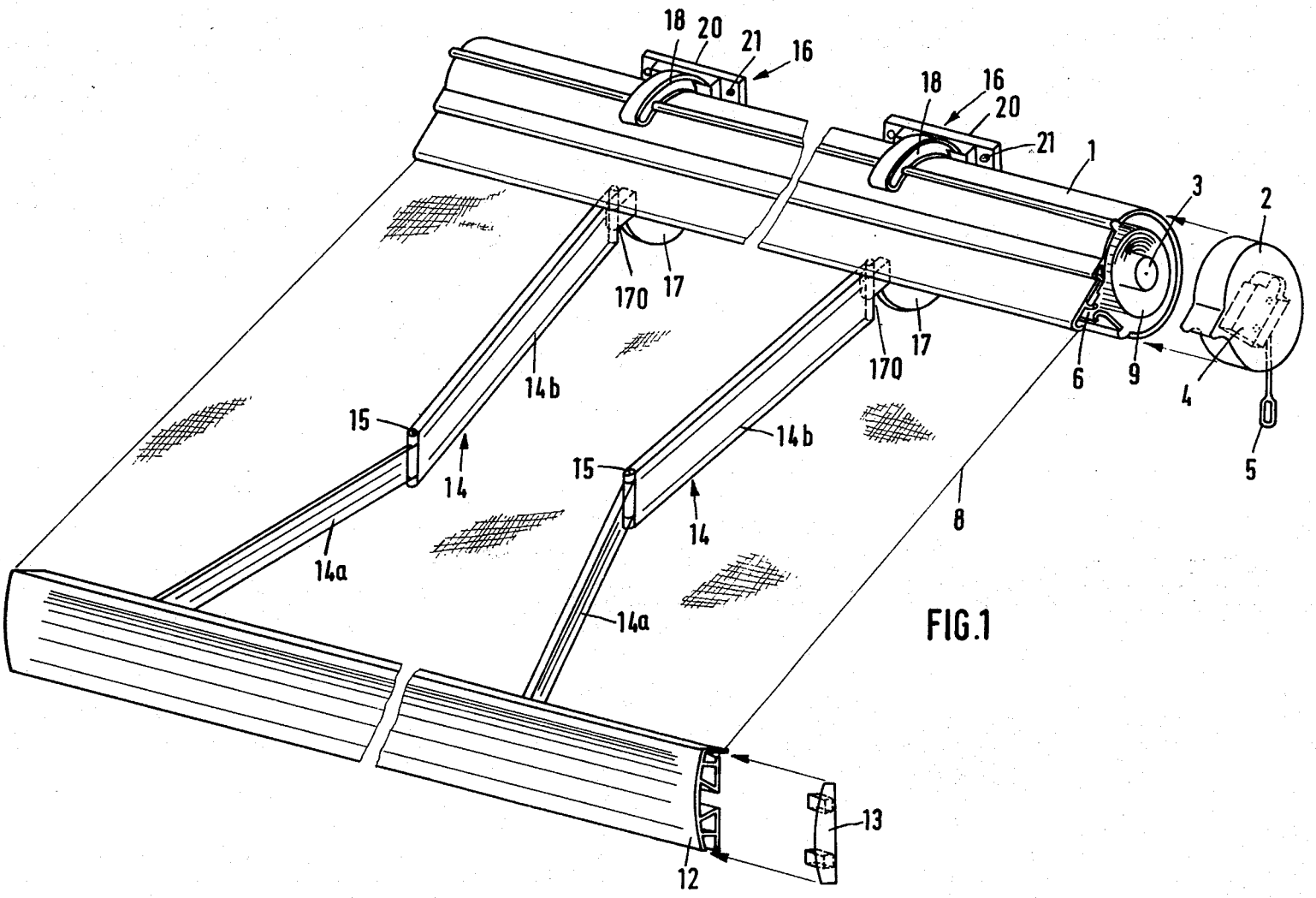
FIG. 1 is a perspective view, partially diagrammatic, of an awning according to the invention, shown in the extended condition.
Figure 2:
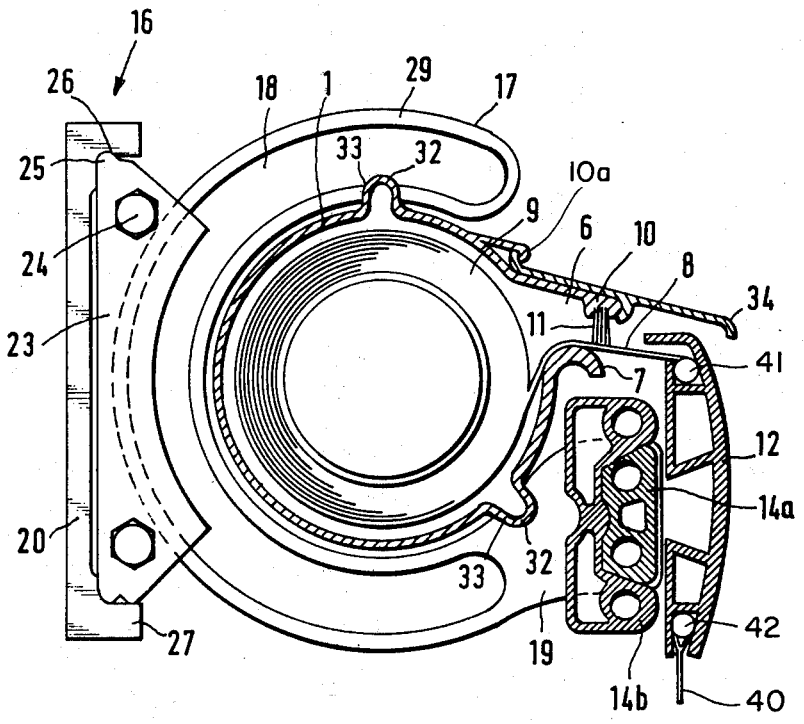
FIG. 2 is a cross-section of the awning of FIG. 1, shown in rolled-up condition.

The awning shown in FIGS. 1 and 2 has an awning housing 1 made of a section of light-metal extruded tubing on which cap-like end pieces 2 are fitted over the ends. The end pieces 2 provide bearings for the awning roller shaft 3 centrally located in the housing 1. The shaft 3 is coupled to a roller drive 4 from which hangs an actuating eye 5 which can be pulled by a suitable cord (not shown) to roll up the awning.

The cylindrical housing 1 is closed on all sides except for the slot-like longitudinal opening 6, that is bounded at its lower edge by a circularly rounded guiding lip 7, over which the web 8 feeds up onto the roller shaft 3 to form a web roll 9 when the awning is rolled up. On the top side of the slot 6 a projecting fin ridge 10 is formed integrally with the housing. As shown in FIG. 2, the fin 10 carries a web-brush 11 extending along its length and projecting downward to brush off the upper side of the web 8 as the web goes into or out of the housing.

The outer end of the web 8 is fastened to a bottom slat 12 that is made of a hollow extrusion of light metal closed off at the ends by end pieces 13. The bottom slat 12 is pivotally connected with two extension arms 14, each of which consists of two arm members 14a and 14b articulated at both ends so they can fold in on each other to the folded position shown in FIG. 2, in which the arms and bottom slat fold right up against the housing. The bottom slat acts as a pull-out member, and may be provided by a pull lead, as partly shown at 40 on FIG. 2. A tubular member 41 may be attached to the end of the awning web 8 and slipped into the slat 12 during assembly, to facilitate replacement of the web or of the slat. Likewise a tubular member 42 may be slipped into the slat to hold a pull cord 40, or to hold a decorating fringe, or both.

The housing 1, which has an inner diameter somewhat greater than the outer diameter of the fully rolled-up awning roll 9. In the illustrated embodiment the housing 1 is held in two holders 16 partly encircling and grasping it and rotatably adjustable about a horizontal axis coinciding with the axis of the shaft 3. These holders are mounted on a wall or the like, not shown in the drawing. Pivots 170 on the forward end of each holder provide articulated mounts for the arms 14.

Each wall-mounted holder 16 has a bracket 17 with a circular C-shaped portion 18 that fits the cylindrical periphery of the housing 1. The lower extremity of the bracket 17 is the pivot-carrying portion 19 that carries a pivot or pivot socket for the arm 14.

The bracket 17 is clamped by its circular portion 18 in a position corresponding to the desired inclination of the extended awning (compare FIG. 1), by clamping it to a wall-mounted base 20 that is provided with mounting holes 21 allowing the holder 16 to be affixed to a wall or other surface with suitable screws. Each wall-mounted base 20 (FIGS. 3 and 4) carries two clamping shells 22 and 23 for respectively fitting and engaging the two sides of the C-shaped portion 18 of a bracket 17. Of these the shell 22 can be rigidly fixed to or made part of the mounting base 20, while the other clamping shell 23 is screwed to the fixed shell 22 by screw studs 24.

Figure 3:
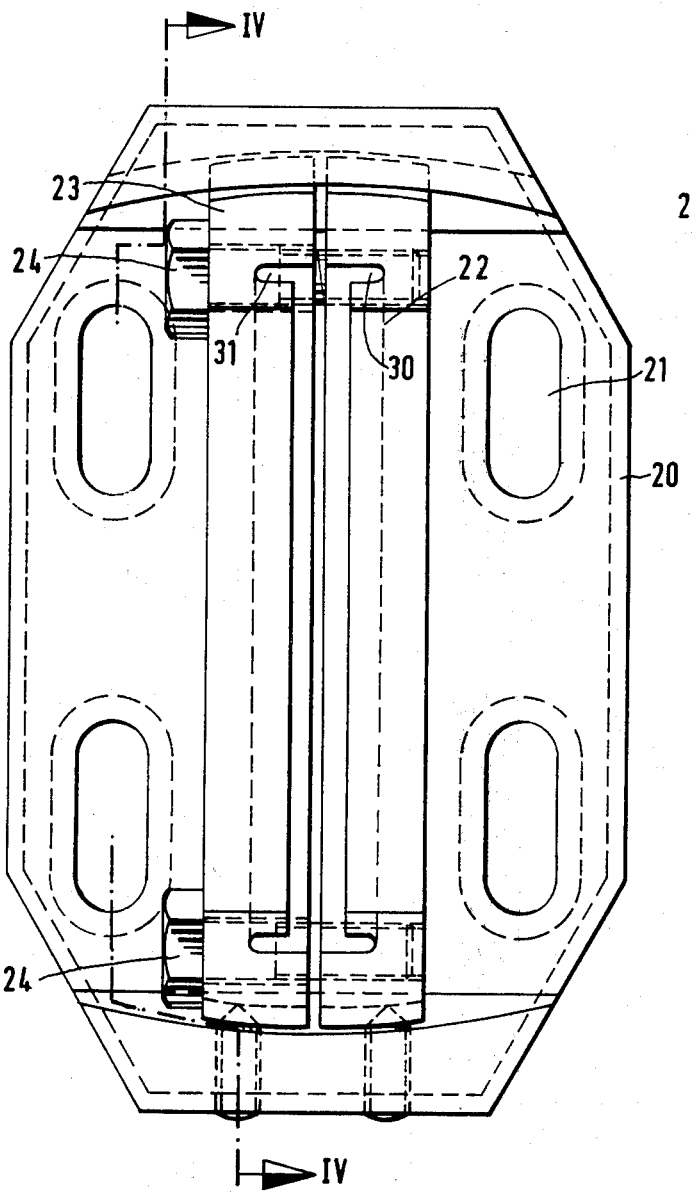
FIG. 3 is a front view of the wall-mounted base portion of a holder for the awning of FIGS. 1 and 2, shown on a larger scale.
Figure 4:
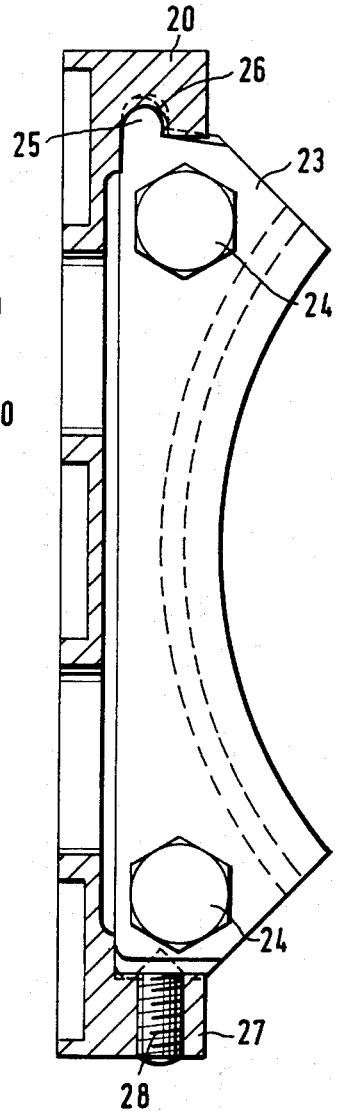
FIG. 4 is a side view of the wall-mounted awning holder base of FIG. 3.

This construction can also be so constituted, as is evident from FIGS. 3 and 4, that both shells 22 and 23 are parts separate from the mounting base 20. The shells 22 and 23 each have at one end a round bulge 25 with which it engages with the base 20 in a groove 26 of the latter (FIG. 4). At the opposite ends, a forwardly extending ledge 27 of the base 20 has set screws 28 passing through threaded holes that respectively register with depressions in the shells 22 and 23 and thus enable the shells to be tightly locked onto the base 20. This form of construction with the clamping shells 22 and 23 both separate from the wall-mounting base 20 makes it possible to adjust the shells somewhat about an axis perpendicular to the surface to which the base 20 is affixed and thereby to compensate during installation for deviation from flushness in the affixation of the base.

In each case a bracket 17 is clamped by its C-shaped portion 18 (FIG. 2) by the two clamping shells 22 and 23 of a wall-mounted holder 16, and for this purpose each bracket 17 is provided at its C-shaped portion 18 with two molded-in sideways projecting ribs 29 that fit and interlock into circular arc grooves 30 and 31 respectively of the clamping shells 22 and 23.

The housing 1 itself is held fixed against rotation in the bracket 17. For this purpose the housing is provided with longitudinal ribs 32, of which two are shown in FIG. 2, but of which two more may be provided, for example as many as six, each fitting into a corresponding notch 33 on the inner circumference of the C-shaped portion 18 of the holding bracket 17.

The fin strip 10 cooperates with a hooked strip 10a near its root to hold a cover slat 34 extending over the length of the housing which, as is clearly shown in FIG. 2, provides a shelter over the bottom slat 12 in the closed position of the awning and acts to prevent the penetration of driving rain and the like into the housing.

As is evident from FIGS. 1 and 2, the awning in its rolled-up condition can be handled as a unit that is fully enclosed by the housing 1, the bottom slat 2 folded up against the housing and the end caps 2. For the mounting of this unit it is necessary to slide the proper number of brackets 17, determined with respect to the length of the particular awning, onto the housing, along the lengthwise ribs 32 thereof and to mount a corresponding number of wall-mounting bases 20 on the wall or other mounting surface at suitable places. After the assembly of the clamping shells 22 and 23 on each bracket 17 and the tightening of the screws 24 in a position approximating the desired location, the awning housing 1 can be simply and effectively anchored on the wall-mounted bases 20 by inserting the rounded extremities 25 into the corresponding grooves 26 of the mounting bases and slipping the lower extremities of the shells 22 and 23 onto the ledge 27. After the tightening of the clamping screws 28 the awning is securely held on the wall-mounted bases 20. The screw studs 24 can then be loosened and the housing 1, together with the extension arms 14 and the brackets 17 can be rotated to provide the exact inclination desired for the extension arms 14 in their extended position, after which the awning can be locked in this position by tightening the screw studs 24.

Even for long lengths of the shaft 23, the awning does not require any intermediate bearing for the shaft, because the shaft 3 can only bend far enough to bring the web roll 9 of the awning against the smooth cylindrical inner surface of the housing 1 where it, and the shaft with it, will be supported. That has the advantage that adjacent webs, directly touching each other or overlapping, can be used without any necessity of providing cover strips to close the slits between neighboring webs.

Figure 5:
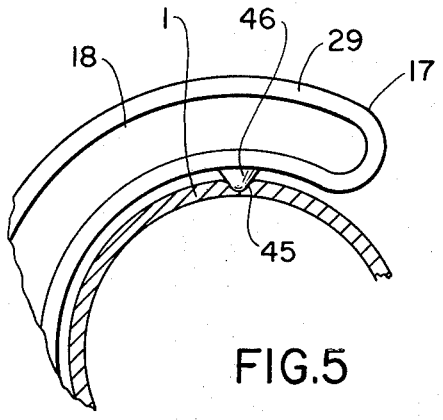
FIG. 5 is a detail view of an alternate form of holder bracket and awning housing engagement, shown partly broken away, and shown next to FIG. 2 for comparison.

FIG. 5 shows a modified form of bracket and housing that may be used for locking the rotary position of the housing to the brackets 17 instead of the form shown in FIG. 2. In this case the housing is provided with grooves 45 instead of the ridges 32 shown in FIG. 2 and the brackets 17 are provided with projections 46 instead of cut-outs 33 shown in FIG. 2. In the construction shown in FIG. 5 the housing must be thicker, at least in the neighborhood of the grooves 45, in order to keep the inner surface smooth and substantially cylindrical, but if a thicker housing or one with a non-circular outer profile providing thickened portions should be desired for other reasons, the type of arrangement shown in FIG. 5 for locking the rotary position of the housing and of the brackets 17 together may be found practical.

Thus, although the invention has been described in detail with particular respect to one illustrative embodiment, it is evident that modifications and variations may be made within the inventive concept.

I claim:

1. A retractable awning comprising:

a tubular awning housing having a longitudinal forward slot and closed off at the end by cap-like members;

an awning roll-up shaft rotatably mounted in said awning housing;

a bottom slat connected to extension arms such as are able to fold up against said housing in the retracted state of said awning, and a plurality of adjustable holders (16) for holding said housing (16) each at least partly grasping around said housing (1) and each having mounting means on which an end of one of said extension arms is pivotally mounted, said adjustable holders each being mounted, rotatably about a horizontal axis common to all said adjustable holders, on a wall fixture, and having means for locking and unlocking said holder relative to said fixture with regard to rotation on said axis for adjusting the position of said housing about said axis.

2. An awning as defined in claim 1 in which each of said adjustable holders comprises a bracket (17) fitting the circumferential shape of said housing (1) and having at least one portion (18) of circular C-shape mounted by being clamped to one of said wall fixtures.

3. An awning as defined in claim 2, in which each of said wall fixtures is equipped with clamping shells (22, 23) fitting the cross-section of said circular C-shaped portion (18) of said brackets (17) and with means for clamping said shells respectively against said brackets on both sides of said brackets.

4. An awning as defined in claim 3, in which each of said brackets, in the region of its C-shaped portion (18) has at least one circularly running rib (29) fitting into a corresponding groove (30) of the corresponding clamping shell (22, 23).

5. An awning as defined in claim 2, in which said housing (1) is connected to said brackets (17) in a manner preventing relative rotation.

6. An awning as defined in claim 5 in which said housing has at least one longitudinal rib (32) formed thereon cooperating with a corresponding notch (33) in each of said brackets.

7. An awning as defined in claim 5, in which said housing has at least one longitudinal groove (45) formed therein cooperating with a corresponding projection (46) in each of said brackets.

8. An awning as defined in claim 1, in which said housing is substantially cylindrical.

9. An awning as defined in claim 8, in which an awning web is fastened along its inner end to said awning roll-up shaft and along its outer end to said bottom slat and in which the inner diameter of the housing (1) is only slightly larger than the outer diameter of the roll formed by said awning web in the maximally rolled up condition thereof.

10. An awning as defined in claim 1, in which said housing (1) is closed except for said longitudinal slot (6) and is provided in the neighborhood of said slot with an elongated brush (11), extending over the length of said slot and arranged to brush an awning web passing through said slot.

11. An awning as defined in claim 10, in which said slot (6) is bounded on one side by a rounded-off guiding lip (7).

* * * * *